United States Patent [19]

Ranson

[11] 4,020,737

[45] May 3, 1977

[54] CARTRIDGE LOADING MACHINE

[76] Inventor: Charles R. Ranson, 28412 Crachman Lane, Highland, Calif. 92346

[22] Filed: May 19, 1975

[21] Appl. No.: 578,410

Related U.S. Application Data

[63] Continuation-in-part of Ser. No. 385,921, July 26, 1973, abandoned.

[52] U.S. Cl. ..... 86/23; 86/26; 86/31; 86/39

[51] Int. Cl.[2] ..... F42B 33/02

[58] Field of Search ..... 86/23, 26, 39, 31

[56] References Cited

UNITED STATES PATENTS 3,408,892 11/1968 Smith et al. ..... 86/23

*Primary Examiner*—Stephen J. Lechert, Jr.
*Attorney, Agent, or Firm*—Herzig & Walsh, Inc.

[57] ABSTRACT

A manual cartridge loading machine. The machine has six stations at which cartridges are operated on. Cooperable with the stations is a manually actuatable head carrying dies which execute the operations on the cartridge cases. The operations which are executed at the stations include: feeding the cartridge case; sizing the case and removing the old primer; belling the mouth of the case and seating the new primer; feeding the powder; feeding the bullet in the case; and taper crimping the case. Cartridges are shifted from station to station by a manually actuatable shifting plate which is constrained for quadrilateral movement, that is, in and out with respect to the stations, and right and left in a direction parallel thereto. A safety latch is provided so that the head cannot be manually pulled down unless the cartridges have been shifted by the shift plate. New primers are individually fed into position at a station at which the old primer is removed from the cartridge and the new primer inserted and set by downward movement of the head.

10 Claims, 13 Drawing Figures

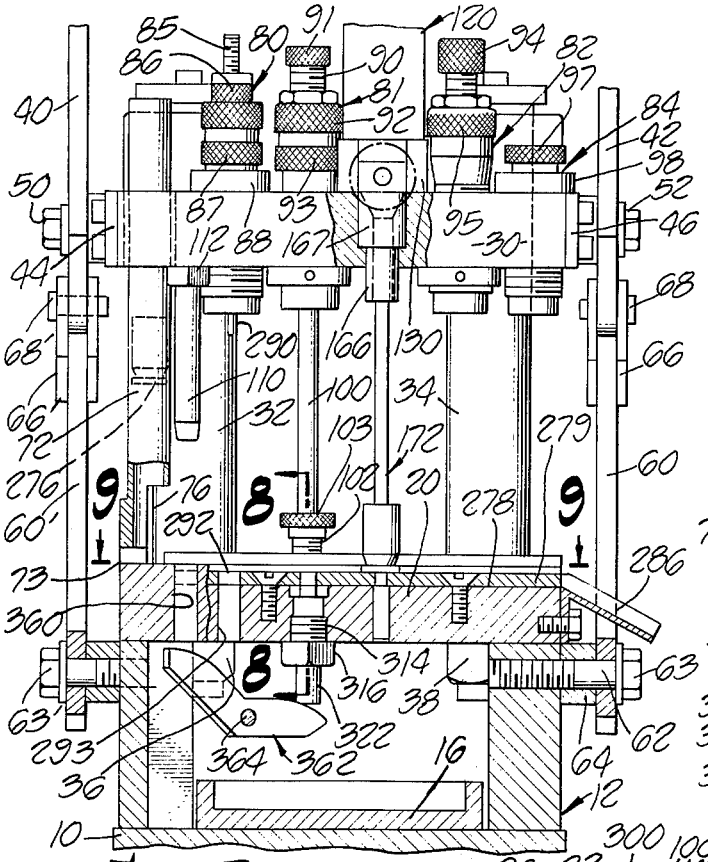
FIG. 7.
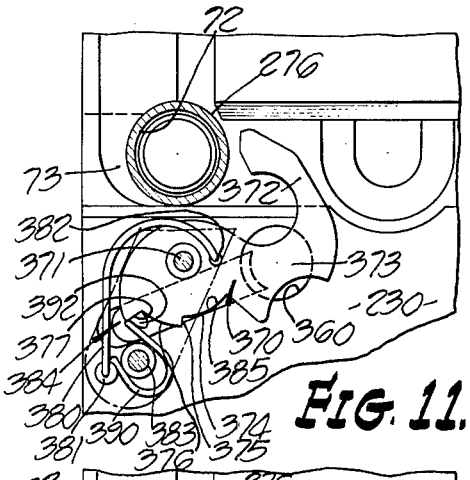
FIG. 11.
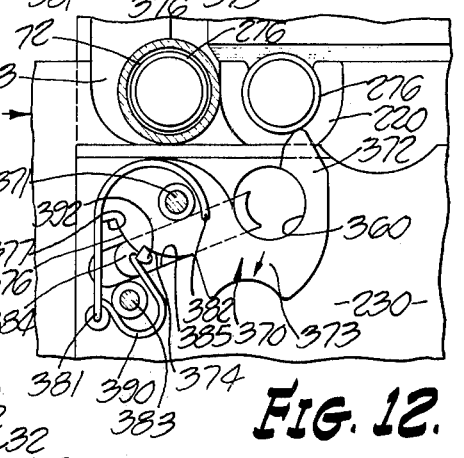
FIG. 12.
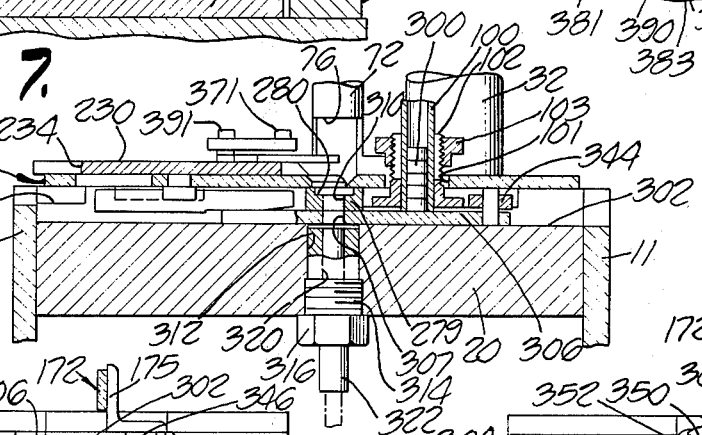
FIG. 8.
FIG. 9.
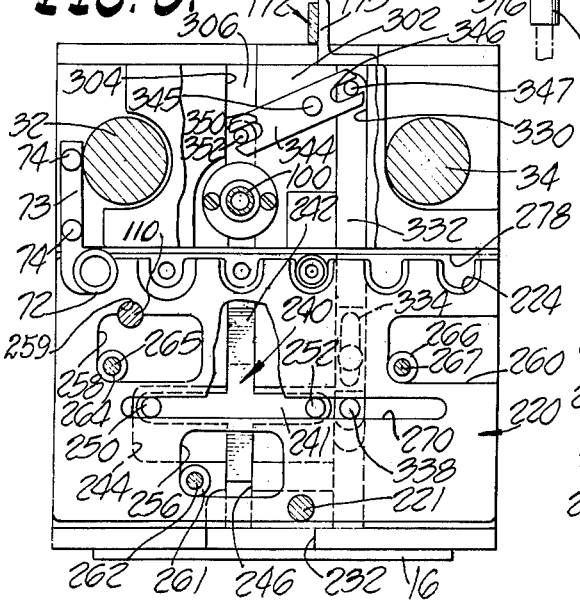
FIG. 10.
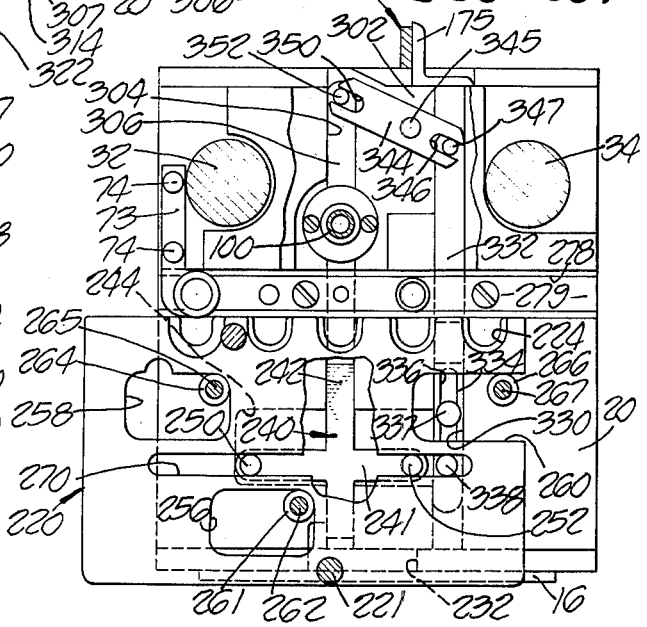

CARTRIDGE LOADING MACHINE

This application is a continuation-in-part of Ser. No. 385,921, filed July 26, 1973, now abandoned.

SUMMARY OF THE INVENTION

The invention is a cartridge loading machine which in the preferred form as described in detail herein is manually operated. In the preferred form, there is a base platform having six stations for operations on cartridges which are moved sequentially from station to station. The cartridges are moved by a mechanism including a manually operable shift plate which shifts all cartridges together one station at a time.

Overlying the stations is a manually actuatable head carrying dies which is manually moved downwardly towards the platform so that the dies can act on the cartridges. The operations which are executed on the cartridges are those set forth in the foregoing abstract.

BACKGROUND OF THE INVENTION

Loading machines are known in U.S. Pat. Nos. 2,061,977; 2,091,397; 3,800,830; and 3,345,903.

The herein invention embodies highly desirable improvements not present in or known to the prior art which are calculated to realize important objectives.

In general, the broad objective of the invention is to provide an improved, positive acting, reliable, dependable, manually operated machine for reloading cartridges by performing the individual steps of feeding the case, sizing the case, and removing the old primer, belling the mouth of the case and seating the new primer; feeding of the powder; seating the bullet in the case; taper crimping the case; and final discharge of the loaded cartridge from the machine.

In the achievement of the general objective, novel constructions are embodied in the machine which make possible the achievement of specific corollary objectives.

One of such corollary objects is to realize improved, positive, manually actuatable means for shifting the cartridges between stations comprising a shift plate which is physically constrained to be movable only normally to the line of stations and in directions parallel thereto.

Another object is to provide improved mechanism for removing the old primer from the cartridge and feeding and seating a new primer in the cartridge, said means comprising dies for removing the old primer which is actuated simultaneously with means in the form of a plunger stem which seats the new primer which has been positioned for seating. These operations are manually effected.

Another object is to realize safety in the provision of safety latch mechanism which prevents actuation of a head carrying the dies unless the manually actuatable shift plate has been actuated to advance the cartridges to the next station. This prevents actuating the head carrying the dies to attempt to perform a function on the cartridge cases without the cases having been advanced which could result in damage to a case or a safety hazard resulting from attempting to perform the same operation on a case twice. This latching mechanism embodies a safety latch which blocks entrance into a bore in the platform of the machine by a plunger carried by the head unless the shift plate has been actuated.

Another object is to provide improved powder feeding means which are more accurate and more reliable, this means embodying an adjustment of the size of the transfer opening which receives the individual charge of powder, and improved means for agitating the hopper when it discharges powder into the transfer carriage and when it is transferred from the carriage into the delivery tube to the station at which the powder is charged into the cartridge.

Another object is to provide improved coupling means between the cartridge shifting plate and the primer delivery and transfer means whereby upon actuation of the plate, a new primer is delivered into position for being set in the cartridge after removal of the old primer.

BRIEF DESCRIPTION OF THE DRAWINGS

Further objects and additional advantages of the invention will become apparent from the following detailed description and annexed drawings, wherein:

FIG. 7 is a sectional view taken along line 7—7 of FIG. 3;

FIG. 8 is a sectional view taken along line 8—8 of FIG. 7;

FIG. 9 is a sectional view taken along line 9—9 of FIG. 7;

FIG. 10 is a view like FIG. 9 showing the actuator for the primary delivery mechanism in an opposite position;

FIG. 11 is a partial view of the safety mechanism which prevents downward actuation of the head unless the actuator plate has been actuated to advance cartridges to the next station; and FIG. 12 is a view like FIG. 11 with the safety mechanism in its other position.

DESCRIPTION OF THE PREFERRED EMBODIMENT

General Organization of the Machine

The general organization of the machine will be described first, followed by a detailed description of its component and subcomponent parts.

Figure 1:
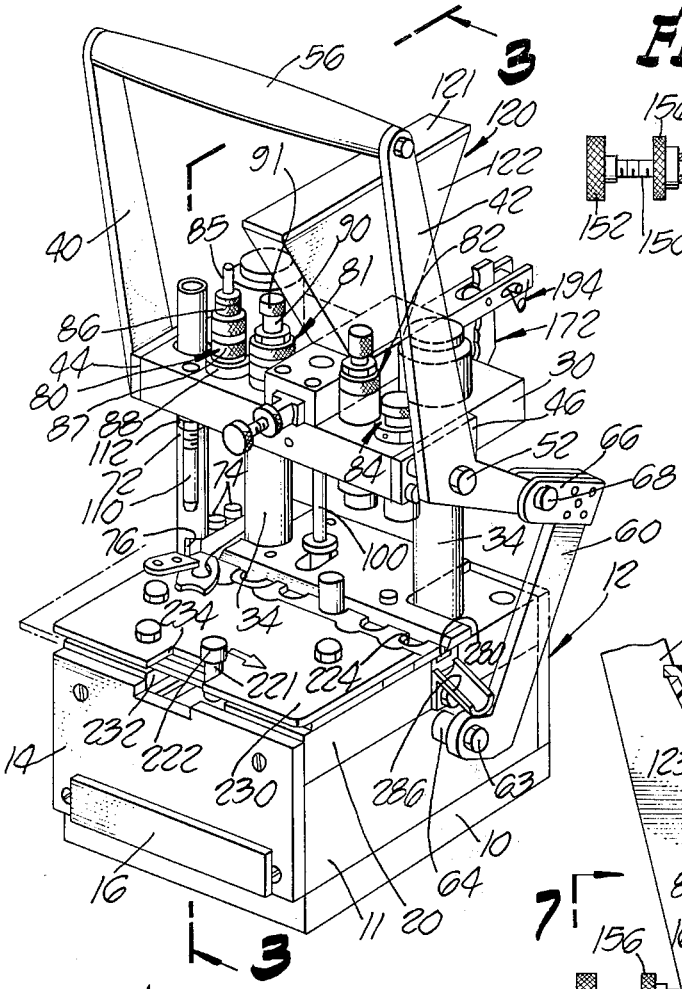
FIG. 1 is a perspective view of a preferred form of the invention.
Figure 3:
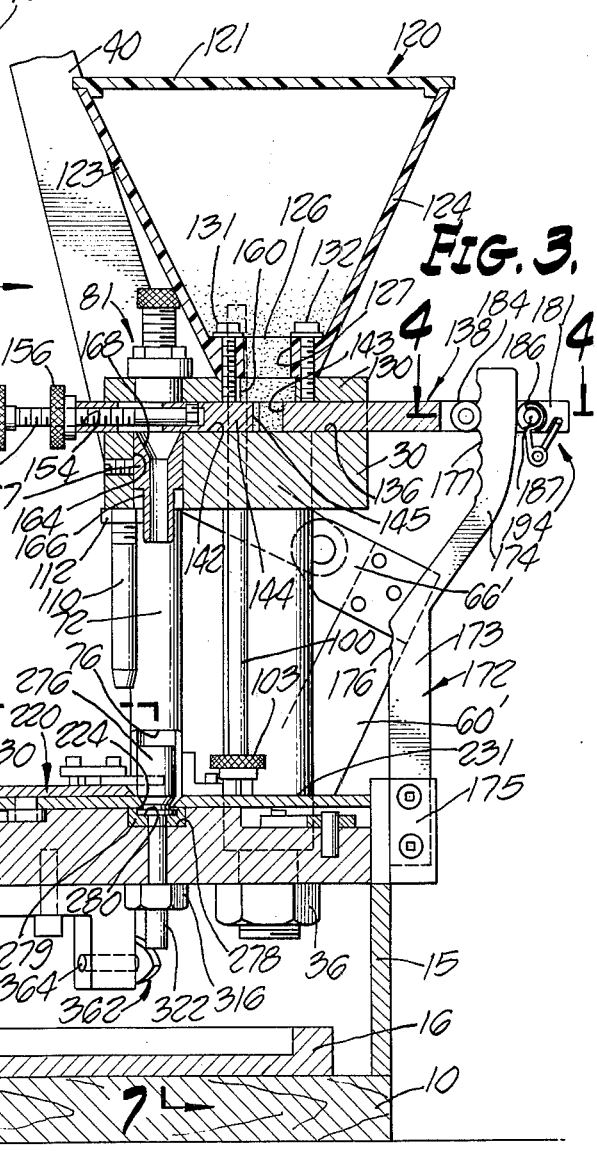
FIG. 3 is a sectional view taken along the line 3—3 of FIG. 1.

The general organization of the machine will best be understood from FIGS. 1, 3, and 7. The machine rests on base 10 which may be made of any suitable material, such as plastic or composition. The lower part of the machine resting on base 10 is in the form of a rectilinear housing 12 having side walls 11 and 13, a back wall 15, and a front wall 14 attached by screws and having an opening to receive drawer 16. The top of bottom housing 12 is in the form of a relatively thick platform member 20 that is attached to the side walls by being bolted thereto.

Manually actuatable head 30 is in the form of a relatively thick, flat plate. Head 30 is reciprocatable vertically on a pair of upright cylindrical columns upstanding from top member or platform 20 and being bolted thereto by nuts 36 and 38.

Head 30 is actuatable by a pair of bell crank levers 40 and 42. Attached to opposite sides of head 30 are plates 44 and 46 which are attached by screws as may be seen. The elbows of bell crank levers 40 and 42 are pivotally attached to plates 44 and 46 by way of screws shown at 50 and 52. Extending between the ends of the upper legs of bell crank levers 40 and 42 is a manual handle 56. Numeral 60 designates a lever connected to lever 42. Lever 60 has an angular end part which is journalled on bolt 62 having head 63 which extends through bushing 64 and is threaded into side member 15 of base 12 of the machine. Attached to the other end of lever 60 is a right angle part 66 in the form of a yoke having a pair of legs. Fitting between these legs and journalled on a pivot shaft 68 is the end of the bell crank lever 42. A similar lever 60' and an associated assembly is provided on the other side of the machine. This lever has pivotal connection to lever 40.

The relationship of handle 56 and levers 40–42 and 60–60' is such that when handle 56 is manually pulled down, head 30 moves downwardly towards base part 12 guided by columns 32 and 34. Head 30 has openings through which the columns extend.

Head 30 carries mechanisms which cooperate with shell casings which are moved from station to station on platform 20 which will be described more in detail presently. Cylindrical hopper tube 72 has a foot part 73 which is attached to the top platform 20 by screws 74 as may be seen in FIG. 1. One side of it is cut away as shown at 76. The empty casings are fed through hopper tube 72, and they are discharged through the cut away part at the bottom to the first station of the processing stations as will be described. Carried by head 30 at the positions of the respective stations are die holders 80, 81, 82, and 84. These holders hold dies which at the stations perform the operations of sizing the case, belling the mouth of the case, feeding the bullet in the case, and taper crimping the case. Holder 80 holds central die stem 85 by way of knurled threaded collars 86 and 87, numeral 88 identifying a lock ring. Holder 81 embodies a center die stem 90 on which are knurled knobs 91, 92, and 93. Die holder 82 is of similar construction, having a center stem with knurled knobs 94 and 95. Holder 84 has a center stem with knurled knob 97 and locking ring 98.

Numeral 100 designates a tubular feed hopper 100 for primers which extends down through opening 101, top plate 231 being held by threaded collar 102 and nut with knurled knob 103.

Plunger 110 extends downwardly from head 30, being threaded into it and held by lock nut 112.

Carried on head 30 is powder feed hopper 120 which is activated on each manual operation to feed powder to a cartridge and which will now be described in detail.

Powder Feed Hopper

It is carried on head 30 as may be seen in FIGS. 1, 3, 6, and 7. It is triangular in configuration having a top cover 121. Preferably, it is made from clear plastic elements which can be bonded together. It has flat, parallel sides, one of which is designated at 122 and diverging angular sides or ends 123 and 124 as shown in FIG. 3. The sides are attached to or integral with block 126 at the bottom which has a round feed opening 127 in it.

Hopper 120 is mounted on a rectangular slide block 130 which is mounted on plate 30, being attached thereto by screws. Block 126 with opening 127 is attached to slide block 130 by screws shown at 131 and 132. Slide block 130 is provided with a longitudinal, rectangular recess or slideway 136 which receives elongated, rectangular powder feed slide 138 of a size to fit into slide opening 136. A further slide channel or way 142 is formed in slide 138. End 143 of slide 138 is arcuate. Sliding in groove or way 142 is a further slide member 144, the end of which designated at 145 is also arcuate. Lead screw 150 has an inner end which rotatably engages the end of secondary slide 144. On the end of lead screw 150 is a knurled knob 152. The lead screw is threaded through a bore 154 in the end of slide 138, and adjacent the end of the slide is a knurled lock nut 156. Slide block 130 has a round opening 160 in it which registers with opening 127 in the bottom of the hopper. Arcuate end surfaces 143 and 145 form an opening which can be moved to register with opening 160 by movement of powder feed slot 138. The sides of the opening formed by arcuate surfaces 143 and 145 can be adjusted by adjusting knob 52 and lead screw 150 so as to position relatively slide member 144 within slide 138, thereby to adjust the sides of the opening, and to adjust the size of a charge of powder that is fed.

Figure 6:
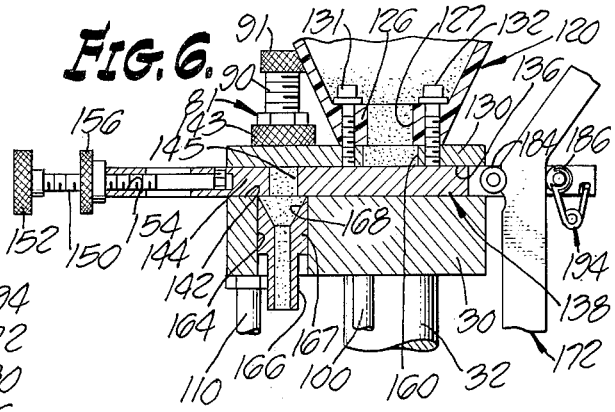
FIG. 6 is a partial sectional view similar to FIG. 3 showing the support head in a lower actuated position with the powder feed slide in a position to feed powder to the powder delivery tube.
Figure 2:
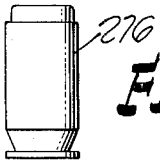
FIG. 2 is a view of a cartridge case to be loaded.

Head 30 has a bore in it designated at 164 which is aligned with the powder feed station on base part 12 as will be described. Numeral 166 designates a powder feed tube at the upper end of which is fitting 167 which fits in bore 164 at the end of which is a tapered bore 168. The opening formed in the two sliders 144 and 138 can be brought opposite or to register with tapered bore 168. Slider 138 is movable between positions as shown in FIG. 3 in which it receives powder from the hopper to a position as shown in FIG. 6 in which powder is fed into powder feed tube 166.

Upon actuation of handle 56 by pulling it downwardly to move head downwardly towards the base, slider 158 is actuated to move a charge of powder to feed it into powder feed tube 166. During this operation, slider 138 is agitated to assure that a full charge of powder feeds down into the opening into and from this opening into the powder feed tube. The mechanism for actuating powder feed slider 138 and agitating it is illustrated in FIGS. 1, 3, 4, 5, and 6.

As may be seen in FIG. 3, numeral 172 designates an angular upright having a vertical part 173 and an angular and vertical part 174, this upright being secured to a bracket 175 at the center part of the back of the machine. Vertical part 173 is scalloped as shown at 176. The inner side of vertical part 174 is scalloped as shown at 177.

Figure 4:
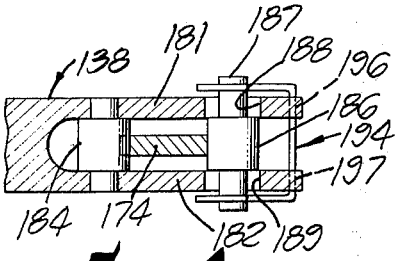
FIG. 4 is a sectional view taken along line 4—4 of FIG. 3.

The extending end of powder feed slider 138 is shown in detail in FIG. 4. It is slotted, forming a yoke having parallel legs 181 and 182. Journalled on a shaft or arbor extending between these legs is a roller 184. A second roller 186 on shaft 187 extends between elongated openings 188 and 189 in legs 181 and 182. The upright 174 extends between rollers 184 and 186. Roller 186 is normally biased against member 174 by a biasing spring 194 (see FIG. 5). The biasing spring has a U-shaped part including bight 195 which normally fits into and is received in slots 196 and 197 in the ends of legs 181 and 182. The legs 200 and 201 of the U-shaped part include extensions 202 and 203. At the junctures between parts 200–202 and parts 201–203 are torsion coils 204 and 205. At the ends of parts 202 and 203 are hooks 206 and 207 which hook into annular grooves in the ends of shaft 187. The spring tension in the spring legs of the biasing spring 194 normally serve to bias or urge roller 186 aganst upright 174. Biasing spring 194 is easily removable manually so that powder feed slider 138 can be removed for cleaning or otherwise.

Figure 5:
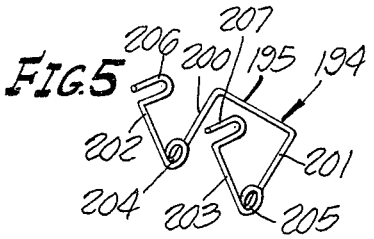
FIG. 5 is a detail view of a biasing spring attachment between the end of the end of the powder feed slide and a roller which engages the scalloped upright which produces agitation of the slide.
Figure 5A:
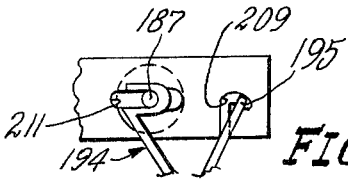
FIG. 5*a* is a side view of the inner end of the powder feed slide.

As shown in FIG. 5*a*, the bight 195 of spring 194 is received in slots as indicated at 209 in the ends of the legs 181 and 182, the ends of the shaft 187 being in slots as shown at 211 in the legs 181 and 182. The spring 194 can be manually disengaged from the shaft 187 which can be slipped out of the roller 186 to provide ready demountability to disengage the slider 138 so that it can be removed forwardly. This is a great advantage to prevent further feeding of powder at a given point in the cycle of operations as desired. For example, if the last cartridge has passed the powder feed station, there are two more stations and it is not desired that powder be feed during passage through them.

In the operation of the powder feed hopper, when handle 56 is pulled down, head 30 moves downwardly as described, and roller 184 moves over scallops 177 of column 172; also against the angular surface of its angular part; over scallops 176. Thus, slide 138 is initially agitated at the beginning of movement of head 30, feeding powder into the opening in slider 138. Slider 138 is then moved to discharge position of FIG. 6, at which position, it is further agitated by scallops 176 to insure that powder is fed into tapered opening 168 of feed tube 166.

Cartridge Advancing Plate

The machine has six stations at which the following operations take place:

Feeding of the cartridge case;
Sizing the case and removing the old primer;
Belling the mouth of the case and seating the new primer;
Feeding of the powder;
Seating the bullet in the case; and
Taper crimping the case.

Cartridge advancing or shifting means are provided which are manually actuated whereby all of the cartridges are shifted one station at a time so that all of the cartridges are sequenced from one station to the next through the six stations.

The advancing of the cartridges is done manually by a cartridge advancing or shifting plate which is manually actuated. This mechanism is illustrated in FIGS. 1, 3, 7, 9, and 10.

The cartridge shift plate is designated at 220 as may be seen in the figures. Attached to its front edge is a manual actuating post 221 having an end knob 222. Cartridge shift plate 220 has quadrilateral movement, that is, it is constrained to move only in a rectangular configuration. Specifically, it can move inwardly towards the cartridges; it can move outwardly normally to the cartridges; and it can move parallel to the line of cartridges in both directions as will be described presently.

The front or inner edge of plate 220 has a series of equally spaced semicircular cutouts, one of which is designated at 224 all of them being alike. Overlying the cartridge shift plate 220 is a cover plate 230 which will be referred to again presently. At the front of platform member 20 there is a cutout 232, and in the front of top cover plate 230, there is cutout 234; these cutouts accommodate quadrilateral movement of actuating stem 221.

Reference will now be made to the top surface of platform 20 which underlies cartridge actuating plate 220 and is shown in FIGS. 9 and 10. Numeral 240 designates a cross member having a part 241 parallel to cutout 224 and a part 242 which is not normal to part 241. Shallow rectangular recess 244 is formed in the surface of platform 220. Cross part 241 can slide in and out in recess 244, that is, in a direction normal to the line of cutouts 224. Cross member 242 which is normal to part 241 slides in groove 246 formed in the surface of platform 20 and is normal to the line of cutouts as indicated at 224. As may be seen from the foregoing, cross member 240 is constrained for movement only in directions normal to the line of stations identified by cutouts 224.

In the ends of part 241 of cross member 240, there are two short circular pin members 250 and 252. Cartridge shifting plate 220 has in it a first rectangular opening 256; a second rectangular opening 258; and a third rectangular opening 260, one side of which is at the end of the plate. Numeral 261 designates a roller on a bolt 262 upstanding from the top of platform 20. Opening 256 engages roller 261 and is movable quadrilaterally in contact with it as will be described. Numeral 264 designates a similar roller on an upstanding bolt 265, this roller being within opening 258. Similar roller 266 is on upstanding bolt 267 which is within opening 260.

Opening 258 has a recess 259 on one side which is in a position to accommodate and receive plunger 110 only when the shift plate 20 is in a pre-determined position ensuring that the head can only be brought down in that position.

Plate 220 further has an elongated transverse slot 270. The two short pins 250 and 252 fit into this slot.

As may be seen in FIG. 3, cartridge 276 may be fed through tube 72 and ejected through opening 76 into a position or space between top cover plate 230 and cover plate 231. Between these cover plates there is formed a groove or channel 278 in the top surface of platform 20. Fitting in this channel is an insert 279 having in it an elongated groove 280 of a size to receive the rims of the cartridge cases as may be seen.

Cartridges 276 are advanced along groove or channel 280 station to station by actuation of cartridge shift plate 220 manually by its actuating stem 221, the plate being moved quadrilaterally as described. As illustrated in FIGS. 9 and 10, cartridge shift plate 220 can be moved normally with respect to the stations as illustrated, and it can be moved parallel to the stations, that is, to the left and right. FIG. 10 shows shift plate 220 moved outwardly and to the left from the position of FIG. 9. Quadrilateral movement is constrained by the engagement of shift plate 220 and cross member 240 and the engagement of rollers 261, 264, and 266 in openings 256, 258, and 260. As may be seen, as shift plate 220 is moved in the manner described, the cartridges at the six stations are moved together in sequence, that is, are advanced from station to station. As the operations of loading the cartridges are completed, the loaded bullet is discharged from the last station 224 into an angular semicircular trough 286 as may be seen in FIG. 1.

Primer Feeding and Setting

At the second station, the old primer in the shell case is removed. At the third station, the mouth of the case is belled; and the new primer is fed into position and set. This mechanism is illustrated in FIGS. 1, 3, 7, 8, 9, and 10.

At the first station, that is, at the cutout like cutout 224 at the left, the cartridges are fed into position for movement from station to station.

At the second station, the casing is sized, and the old primer is removed by die 80. The die holder is threaded into head 30 as may be seen in FIGS. 7 and with an extending die stem 290 which goes through the cartridge casing and removes the die which drops through a bore 292 in channel member 279 through registering bore 293 in platform 20.

Upon actuation of cartridge shifting late 220 by stem 221, the cartridges are advanced one station. At the third station, die 81 bells the mouth of the case and seats the new primer which is fed into position to be seated.

As indicated previously, the feed tube hopper for primers is designated 100, the supply of primers being designated at 300 in FIG. 8. The top surface of platform 20 has a recess 302 formed in it as may be seen in FIG. 8 to accommodate a slider which feeds the primers from the feed tube hopper to the position at which they are set from underneath. Recess 302 also has a recess or guideway 304 formed in it for sliding feed member 306 (see FIGS. 9 and 10). Member 306 has a hole 307 in it of a size to receive a primer from feed tube 100 when this opening registers with the tube (see FIG. 8). Primer 300 is fed into a position as shown in FIG. 8 underneath die holder 81 which is provided with a die for operating to seat the primer. At the position of primer seating, channel member 279 has a round opening 310 in it for purposes as will be described.

Underneath opening 310 in channel member 279 and registering with it is a larger bore 312 in a platform 302. In this bore, is a fitting having a threaded part 314 having a hex nut 316 and it having a bore 320 which receives a reciprocatable primer setting stem 322 which is actuated in a manner to be described.

Setting stem 322 is actuated by movement of cartridge shifting plate 220. The top of platform 20 has recess or way 330 formed in it as shown in FIGS. 9 and 10 which is normal to the line of stations. Fitting in this guideway is slider 332. At its end, there is secured to it a block 334 having parallel slot 336 in it. Block 334 is attached by screw 337, and it has an upwardly extending short, round pin 338 which is engaed in slot 270 in cartridge shifting plate 220. Thus, when plate 220 is moved in a direction normally to a line of stations, slider 332 is moved in and out. Numeral 344 designates a link member pivoted on pivot end 345. One end of the link has a slot 346 in it which engages a short pin 347 upstanding from slider 332. The other end of the link has a slot 350 in it which engages a short upstanding pin 352 in slide member 306 previously described which receives the primers from primer feed tube 100.

From the foregoing, as may be seen, when cartridge shifting plate 220 is shifted inwardly, slider 332 is moved inwardly. This rotates link 334 which moves link 306 outwardly, that is, from a position in which it has received a primer from feed tube 100 and moves it into a position as shown in FIG. 8 where it can be set in a cartridge now positioned in the third station. Handle 56 is now pulled down, and die holder 81 at the third station comes down and bells the mouth of the case and then cooperates with the primer setting stem 322 which moves upwardly.

Whenever head 30 is manually moved downwardly, plunger 110 must go through a bore 360 in platform 20. Safety mechanism is provided as shown in FIGS. 11 and 12 and blocks the passage of plunger 110 through this bore unless cartridge shifting plate 220 has been actuated to shift the cartridges to the next station. This safety mechanism will be described in detail presently.

When plunger 110 is extended through bore 360, it engages one end of bell crank lever 362 which is pivotally mounted within base part or housing 12 of the machine (see FIG. 7). This bell crank lever is pivoted on shaft 364 suitably supported within base 12. The other end of bell crank lever 362 is in engagement with primer setting stem 322 to force it upwardly as stem 110 actuates the bell crank lever. Thus, it may be seen that as handle 56 is pulled down, the primer belling and seating die comes down to act on the cartridge case simultaneously with the primer setting stem 322 coming upwardly through bores 307 and 310 to move primer 300 upwardly and to seat it in the cartridge.

Safety Latch Mechanism

The safety latch mechanism may be seen in FIGS. 1 and 8 and in detail in FIGS. 11 and 12. Numeral 370 designates a locking latch member which is pivotally mounted on stem 371 upstanding from platform 20. Locking latch member 370 is above the surface of cover plate 230. It has an extending hook part 372 which is connected to the main body of the latching member by neck part 373 which in the position of FIG. 11, is over bore 360 in a position to prevent plunger 110 from going down through the bore and thus preventing actuation of the machine, that is, downward movement of handle 56 until such time as the cartridge shift plate 220 has been actuated to move the cartridges to the next station. The part of latch member 370 adjacent to its pivot shaft is generally arcuate, and it has an arcuate portion 374 at the end of which is shoulder or notch 375. It has an arcuate portion 376 at the end of which is another shoulder 377. Bow spring 380 has one end fixed at 381 on the stem extending from platform 20 and the other end of which is attached to latch member 370 at 382 to normally bias the latch member in a clockwise direction. Numeral 384 designates an elongated trigger member which slides in groove 385 in the underside of cover plate 230 and the end of which extends over the end of bore 360. This end of the trigger member is bevelled so as to be engageable by plunger 110 to be pushed back in its slot. Trigger member 384 is biased towards bore 360 by bow spring 390, one end of which is held by pin which holds the end of bow spring 380. It loops around pin 383; and at its other end, it carries a latch dog 392 which is engageable with shoulders 375 and 377 of latch member 370.

The operation of the safety latch mechanism is as follows. In the position of FIG. 11, neck 373 of the latch member blocks bore 360 from penetration by plunger 110. In the position of FIG. 11, latch dog 392 is in engagement with shoulder 377 and holds latch member 370 in that position. If cartridge shifting plate 220 is properly actuated to advance cartridges one station, cartridge 276 as shown in FIG. 11 engages hooked end 372 of latch 370, moving it clockwise to a position shown in FIG. 12 in which the arcuate surface of hook part 372 is adjacent the periphery of bore 360 so as to allow plunger 110 to enter the bore. When a cartridge engages hooked end 372 of latch member 370, moving it in a clockwise direction illustrated in FIG. 12, the arcuate interior surface of hook part 372 is moved so that it coincides with the periphery of bore 360 to allow plunger 110 to penetrate it. Shoulder 377 is moved away from latch dog 392 in a clockwise direction which is now moved into a position to engage shoulder 375, latching latch member 370 in the position of FIG. 12. When plunger 110 now enters bore 360, it engages the bevelled end of trigger member 384, sliding in its slot so that latch dog 392 disengages from shoulder 377, allowing latch member 370 to rotate in a counterclockwise direction under the influence of bow spring 380 so that it moves back into a position of FIG. 11. Thus, each time that handle 56 is to be pulled down for an actuation, it is assured that cartridge shifting plate 220 has to be shifted to advance the cartridges to the next station. Thus, the safety factor is assured that the handle is not pulled down without advancing the cartridges so that the correct sequence of operations will not be impaired and damage would not be done on any cases nor would there by any lack of safety.

It is to be seen that the latch member 37 is moved out of the way by a cartridge at the initial station. It is unlatched by the plunger and must be moved and relatched for the next cartridge at the initial station.

From the foregoing, those skilled in the art will fully understand the construction of the invention, its operation, and the manner in which it achieves and realizes all of the objectives as set forth in the foregoing. The operation which is executed at each of the six stations is accomplished by simply manually pulling down handle 56. The cartridge cases ae manually sequenced together from individual stations to the next so that each of the individual operations is preformed on each cartridge case. The machine is constructed to be extremely reliable and positive in operation, and because of the safety latch mechanism, safety is assured.

The foregoing disclosure is representative of a preferred form of the invention and is to be interpreted in an illustrative rather than a limiting sense, the invention to be accorded the full scope of the claims appended hereto.

What is claimed is:

1. In a cartridge reloading machine, in combination: platform means and cartridge case moving means movable between a plurality of processing stations; a head mounted over the position of the procesing stations; a head mounted over the position of the processing stations; a head mounted over the position of the processing stations and carrying die means positioned to be operable upon a cartridge case at each of the individual stations, said cartridge moving means comprising a manually movable shift plate having portions engageable with cartridges at all of a plurality of stations; means constraining said plate for movement to simultaneously move all of the plurality of cartridges from an individual station to the next station, said shift plate overlying the platform means, a guide member carried by the platform means and constrained to move in a direction normal to a line of stations, the shift plate having engagement with the guide member whereby the shift plate is constrained to move with the guide member in directions normal to a line of stations and means whereby the shift plate can move relative to the guide member in directions parallel to a line of stations, the shift plate thereby being constrained to rectangular movement, and means limiting the said normal and parallel movements, the machine having a station at which a new primer is delivered to the station and set in the cartridge and means movable by the shift plate for delivering a primer to the station and upwardly actuatable stem means actuatable with movement of the head for setting a primer in the cartridge.

2. A machine as in claim 1 including a new primer delivery hopper tube, a transfer slide cooperable with the delivery tube for receiving and transferring a primer to the primer resetting station, and linkage means whereby said transfer slide is operable by movement of said cartridge shift plate.

3. A machine as in claim 2 wherein said transfer slide has an opening in it positionable to register with said primer resetting plunger stem whereby said stem is actuatable to engage said primer and move it into position to be seated in a cartridge case.

4. In a cartridge reloading machine, in combination: platform means and cartridge case moving means movable between a plurality of processing stations; a head mounted over the position of the processing stations; a head mounted over the position of the processing stations and carrying die means positioned to be operable upon a cartridge case at each of the individual stations, said cartridge moving means comprising a manually movable shift plate having portions engageable with cartridges at all of a plurality of stations; means constraining said plate for movement to simultaneously move all of the plurality of cartridges from an individual station to the next station, said shift plate overlying the platform means, mechanism whereby the shift plate is constrained to movements normal to and parallel to the line of stations, said mechanism including a guide member movable in a slot normal to one of said movements, means providing mutual engagement between the guide member and shift plate constraining the shift plate to movement normal to the movement of the guide member.

5. A machine as in claim 4 wherein the shift plate has a rectangular opening in it, an upright pin positioned in said opening to limit movements of the plate.

6. In a cartridge reloadng machine, in combination; platform means and cartridge case moving means movable between a plurality of processing stations; including an initial station; a head mounted over the position of the processing stations and carrying die means positioned to be operable upon a cartridge case at each of the individual stations, said cartridge moving means comprising a manually movable shift plate having portions engageable with cartridges at all of a plurality of stations; means constraining said shift plate for movement to simultaneously move all of the plurality of cartridges from an individual station to the next station, and means embodying a safety latch mechanism whereby downward actuation of said head is prevented unless preceded by manual actuation of the shift plate, said last means comprising a bore in the platform having the processing stations, a plunger carried by the head cooperable with said bore, a latch member for blocking said bore, and means whereby said latch member is moved to unblocking position by movement of a cartridge case from said initial station.

7. A machine as in claim 6 including latch dog means for latching the latch member in unblocking position, said latch dog means including means positioned to be actuated by the plunger for unlatching the latch member whereby downward actuation of the head must be preceded by movement of the shift plate.

8. A machine as in claim 6 wherein said shift plate has an opening positioned to register with said plunger only when the shift plate is in a predetermined position.

9. In a cartridge reloading machine, in combination; platform means and cartridge case moving means movable between a plurality of processing stations; a head mounted over the position of the processing stations; a head mounted over the position of the processing stations and carrying die means positioned to be operable upon a cartridge case at each of the individual stations, said cartridge moving means comprising a manually movable shift plate having portions engagable with cartridges at all of a pluralty of stations; menas constraining said plate for movement to simultaneously move all of the plurality of cartridges from an individual station to the next station, said shift plate overlying the platform means, a guide member carried by the platform means and constrained to move in a direction normal to a line of stations, the shift plate having engagement with the guide member whereby the shift plate is constrained to move with the guide member in directions normal to a line of stations and menas whereby the shift plate can move relative to the guide member in directions parallel to a line of stations, a powder-feed hopper carried by said head, a powder transfer slide having a powder receiving opening in it positionable to register with the powder hopper and to receive powder from it, said powder transfer slide being movable to a position to deliever powder to a powder delivery tube leading to a powder refill station, said powder transfer slide carrying an adjustable secondary slide, said powder receiving opening being formed by portions of said slide whereby its size can be adjusted.

10. In a cartridge reloading machine, in combination: platform means and cartridge case moving means movable between a plurality of processing stations; a head mounted over the position of the processing stations; a head mounted over the position of the processing stations and carrying die means positioned to be operable upon a cartridge case at each of the individual stations, said cartridge moving means comprising a manually movable shift plate having portions engageable with cartridges at all of a plurality of stations; means constraining said plate for movement to simultaneously move all of the plurality of cartridges from an individual station to the next station, said shift plate overlying the platform means, a guide member carried by the platform means and constrained to move in a direction normal to a line of stations, the shift plate having engagement with the guide member whereby the shift plate is constrained to move with the guide member in directions normal to a line of stations, a powder-feed hopper carried by said head, a powder transfer slide having a powder receiving opening in it positionable to register with the powder hopper and to receive powder from it, said powder transfer slide being movable to a position to deliver powder to a powder delivery tube leading to a power refill station, a fixed member carried by the machine and having engagement with the powder transfer slide, the engaging parts being constructed whereby upon downward movement of the head, said slide is agitated for delivery of a full charge of powder to the slide and to the powder delivery tube, roller means carried by the slide and engaging the fixed member, a spring clip engaged between the roller means and fixed member, the spring clip and roller means being disengagable from the slide to allow forward removal of the slide.

* * * * *

UNITED STATES PATENT AND TRADEMARK OFFICE

CERTIFICATE OF CORRECTION

PATENT NO. : 4,020,737

DATED : May 3, 1977

INVENTOR(S) : CHARLES R. RANSOM

It is certified that error appears in the above-identified patent and that said Letters Patent are hereby corrected as shown below:

The correct name of the inventor is CHARLES R. RANSOM.

Signed and Sealed this

*nineteenth* Day of *July 1977*

[SEAL]

*Attest:*

RUTH C. MASON
*Attesting Officer*

C. MARSHALL DANN
*Commissioner of Patents and Trademarks*